US008477075B2

(12) United States Patent
Seifried et al.

(10) Patent No.: US 8,477,075 B2
(45) Date of Patent: Jul. 2, 2013

(54) BROADBAND ANTENNA SYSTEM FOR SATELLITE COMMUNICATION

(75) Inventors: Michael Seifried, Altdorf (DE); Michael Wenzel, Kusterdingen (DE); Christoph Häussler, Reutlingen (DE); Jörg Oppenlander, Kirchentellinsfurt (DE); Jörg Tomes, Tübingen (DE); Alexander Friesch, Tübingen (DE)

(73) Assignee: Qest Quantenelektronische Systeme GmbH, Holzgerlingen (DE)

( * ) Notice: Subject to any disclaimer, the term of this patent is extended or adjusted under 35 U.S.C. 154(b) by 221 days.

(21) Appl. No.: 13/082,509

(22) Filed: Apr. 8, 2011

(65) Prior Publication Data

US 2011/0267250 A1 Nov. 3, 2011

Related U.S. Application Data

(63) Continuation of application No. PCT/EP2010/002645, filed on Apr. 30, 2010.

(30) Foreign Application Priority Data

Apr. 30, 2009 (DE) ..... 10 2009 019 291

(51) Int. Cl.
*H01Q 13/00* (2006.01)

(52) U.S. Cl.
USPC ..... 343/772; 343/778; 343/776; 343/786; 343/853

(58) Field of Classification Search
USPC ..... 343/772, 776, 778, 786, 853
See application file for complete search history.

(56) References Cited

U.S. PATENT DOCUMENTS

| | | | |
|---|---|---|---|
| 5,243,357 | A | 9/1993 | Koike et al. |
| 6,201,508 | B1 | 3/2001 | Metzen et al. |
| 6,225,960 | B1 | 5/2001 | Collins |
| 2002/0149531 | A1 | 10/2002 | Smith et al. |
| 2005/0146477 | A1 | 7/2005 | Kelly et al. |

FOREIGN PATENT DOCUMENTS

| | | | |
|---|---|---|---|
| GB | 2 247 990 | A | 3/1992 |
| WO | 97/08775 | A1 | 3/1997 |
| WO | 2006/061865 | A1 | 6/2006 |
| WO | 2008/069369 | A1 | 6/2008 |
| WO | 2010/009685 | A1 | 1/2010 |

OTHER PUBLICATIONS

T. Sehm et al., "*A 38 GHz Horn Antenna Array,*" 28th European Microwave Conference, 1998, IEEE, Piscataway, NJ, Oct. 1, 1998, pp. 184-189.

*Primary Examiner* — Kristy A Haupt
(74) *Attorney, Agent, or Firm* — Burr & Brown

(57) ABSTRACT

An antenna for broadband satellite communication including an array of primary horn antenna elements which are connected to one another by a waveguide feed network.

18 Claims, 11 Drawing Sheets

BROADBAND ANTENNA SYSTEM FOR SATELLITE COMMUNICATION

CROSS REFERENCE TO RELATED APPLICATIONS

This application is a continuation of International Application No. PCT/EP2010/002645 filed Apr. 30, 2010, which designated the United States, and claims the benefit under 35 USC §119(a)-(d) of German Application No. 10 2009 019 291.3 filed Apr. 30, 2009, the entireties of which are incorporated herein by reference.

FIELD OF THE INVENTION

The invention relates to a broadband antenna system for communication between mobile carriers and satellites, in particular for aeronautical applications.

BACKGROUND OF THE INVENTION

The need for wire-free broadband channels for data transmission at very high data rates, particularly in the field of mobile satellite communication, is increasing continuously. However, particularly in the aeronautical field, there is a lack of suitable antennas which, in particular, can satisfy the conditions required for mobile use, such as small dimensions and light weight. Furthermore, directional, wire-free data communication with satellites (for example in the Ku or Ka band) is subject to extreme requirements for the transmission characteristic of the antenna systems, since interference of adjacent satellites must be reliably precluded.

In aeronautical applications, the weight and the size of the antenna system are of very major importance, since they reduce the payload of the aircraft, and cause additional operating costs.

The problem is therefore to provide antenna systems which are as small and light as possible and which nevertheless comply with the regulatory requirements for transmission and reception operation when used on mobile carriers.

The regulatory requirements for transmission operation result, for example, from the standards CFR 25.209, CFR 25.222, ITU-R M. 1643 or ETSI EN 302 186. These regulatory regulations are all intended to ensure that no interference with adjacent satellites can occur during directional transmission operation of a mobile satellite antenna. Typical envelopes (envelope curves) of maximum spectral power density are defined for this purpose, as a function of the separation angle to the target satellite. The values specified for a specific separation angle must not be exceeded during transmission operation of the antenna system. This leads to stringent requirements for the angle-dependent antenna characteristic. As one example, FIG. 5*a* illustrates the requirement from CFR 22.209 for the angle-dependent antenna gain in Ku band in the azimuth direction (tangentially to the Clarke orbit) (bold curve). As the separation angle from the target satellite increases, the antenna gain must decrease sharply. This can be achieved physically only by very homogeneous amplitude and phase configuration of the antenna. Parabolic antennas, which have these characteristics, are therefore typically used. However, antennas such as these are unsuitable for mobile use, in particular on aircraft. Rectangular antenna apertures, or antenna apertures similar to a rectangle, are used to reduce the drag here, with an aspect ratio of the height to width of at most 1:4. Since parabolic mirrors have only very low efficiencies with aspect ratios such as these, antenna arrays are preferably used for applications, for example, on aircraft or motor vehicles.

However, antenna arrays are subject to the known problem of so-called grating lobes. Grating lobes are significant parasitic sidelobes which are created because the beam centers of the antenna elements, which form the antenna array, have to be a certain distance apart from one another, by virtue of the design. At certain beam angles, this leads to positive interference between the antenna elements, and therefore to undesirable emission of electromagnetic power in undesired solid angle ranges. It is evident from the theory of two-dimensional antenna arrays (for example J. D. Kraus and R. J. Marhefka, "Antennas: for all Applications", 3rd Ed., McGraw-Hill series in electrical engineering, 2002) that significant parasitic grating lobes do not occur only if the beam centers of the antenna array are less than one wavelength apart from one another, at the minimum wavelength that is used.

Since antenna arrays must have a feed network, this results in the practical problem of finding network and antenna array topologies which, on the one hand, satisfy the above condition for the maximum distance between the beam centers, and on the other hand occupy as little physical space as possible. Furthermore, the feed networks must be only minimally dissipative, in order to make it possible to achieve high antenna efficiencies, and therefore minimum antenna sizes.

Furthermore, two independent signal polarizations are typically used in order to increase the data rate for directional satellite communication. The antenna system must therefore be able to process two independent polarizations simultaneously. A high level of polarization separation is required both during transmission operation and during reception operation in order to avoid mixing and therefore efficiency losses. Furthermore, there are strict regulatory requirements for the polarization separation for transmission operation in order to avoid interference with adjacent transponders with orthogonal polarization (cf., for example, CFR 25.209 and 25.222). In the case of antenna arrays, it is therefore on the one hand necessary to ensure that the primary antenna elements have sufficiently good polarization separation, and maintains the polarization sufficiently well, and on the other hand that no undesired mixing of the orthogonal polarizations occurs in the feed networks.

Particularly in the case of aeronautical applications, the required polarization decoupling for linear-polarized signals places very stringent requirements on the antenna system. Since systems such as these are typically mounted on the aircraft fuselage and have a two-axis positioner, the azimuth axis of the antenna aperture always lies on the aircraft plane. The aircraft plane is typically a plane tangential to the Earth's surface. If the aircraft position and the satellite position are now not on the same geographical longitude, then the antenna aperture, when it is pointing at the satellite, is always rotated through a specific angle, which depends on the geographical longitude, with respect to the plane of the Clarke orbit. This so-called geographic skew cannot be compensated for in mobile applications by rotation of the antenna about an axis at right angles to the aperture plane, as is possible with stationary terrestrial antennas. Despite the aspect ratio, which is in principle poor, an aeronautical antenna system must therefore be able to comply with the regulatory requirements even in the presence of a geographic skew, up to a specific rotation angle of typically about ±35°.

This results in the following problems for mobile, in particular aeronautical, satellite antennas, which must be solved simultaneously:

1. minimum possible dimension to comply with the regulatory requirements,
2. maximum antenna efficiency with minimum weight,
3. wide bandwidth in order to cover the reception band and the transmission band (for example, Ku band operation: 10, 7-12, 75 GHz and 13, 75-14, 5 GHz),
4. very good directional characteristic,
5. high polarization separation,
6. compensation for the geographical skew by tracking of the polarization planes of the linear-polarized signals.

It is known that antennas which are in the form of arrays of horn antenna elements have a very high efficiency. When arrays of horn antenna elements are fed using a network of waveguides, then the attenuation of electromagnetic waves by such networks may be very small. One such array is proposed, for example, in U.S. Pat. No. 5,243,357. However, this is purely a receiving antenna (Column 1, line 10 et seq.). The very high polarization decoupling which is required for operation as a transmitting antenna cannot be achieved with the proposed network of square waveguides. Furthermore, the distance between the antenna elements is comparatively great, by virtue of the design, since the square waveguides must have dimensions in the region of half the wavelength of the frequency being used, in order to guide waves efficiently, and the centers of the antenna elements are therefore far more than one wavelength apart from one another. It is known that this leads to significant sidelobes (so-called grating lobes) in the antenna characteristic. During pure reception operation, these sidelobes are not a problem. However, transmission operation that is permitted in accordance with the regulations is impossible since, for example, CFR 25.209 and CFR 25.222 place very stringent requirements on sidelobe suppression. The polarization separation can be improved by using separate feed networks. For example, U.S. Patent Application Publication No. 2005/0146477 A1 proposes that a dedicated feed network be used in each case for the left-hand circular polarization and the right-hand circular polarization. The antenna elements (in this case aperture crosses) must, however, be fed in a serial form for this purpose. This greatly restricts the usable bandwidth. Typical Ku band operation, for example with a reception band from 10.7 GHz to 12.75 GHz, and a transmission band from 14.0 GHz to 14.5 GHz, is impossible with an arrangement such as this. U.S. Pat. No. 5,568,160, for example, likewise proposes that the distribution network be fed using aperture crosses. However, in this case, primary antenna elements are square horn antenna elements. The feed network breaks down into a network for the horizontal polarization and a network for the vertical polarization. A high level of polarization decoupling is therefore possible. By virtue of the design, the antenna element centers are, however, a comparatively long distance apart from one another, as a result of which parasitic sidelobes occur. The same problem occurs with the arrangements proposed, for example, in U.S. Pat. No. 6,225,960, International Publication No. WO 2006/061865 A1 and GB Patent Application Publication No. 2247990 A. U.S. Pat. No. 6,201,508 proposes that a grid ("crossed septum"; Column 3, line 26) be fitted over each individual horn antenna element, in order to homogenize the aperture configuration. However, by virtue of the design, the beam centers are also far more than one wavelength apart from one another in this case as well, and parasitic sidelobes, which are dependent on the phase correlation, still occur. By virtue of the design, the apparatus also has a considerable height (extent at right angles to the aperture plane), which makes it virtually unusable for mobile, and in particular for aeronautical, applications ("0.37 m" in the Ku band; Column 5, line 15).

SUMMARY OF THE INVENTION

The object of the invention is to provide a broadband antenna system, in particular for aeronautical applications, which, with minimal dimensions, allows transmission operation and reception operation in compliance with the regulations, and allows the antenna to be aligned precisely with the target satellite.

DETAILED DESCRIPTION OF THE INVENTION

Figure 1A:
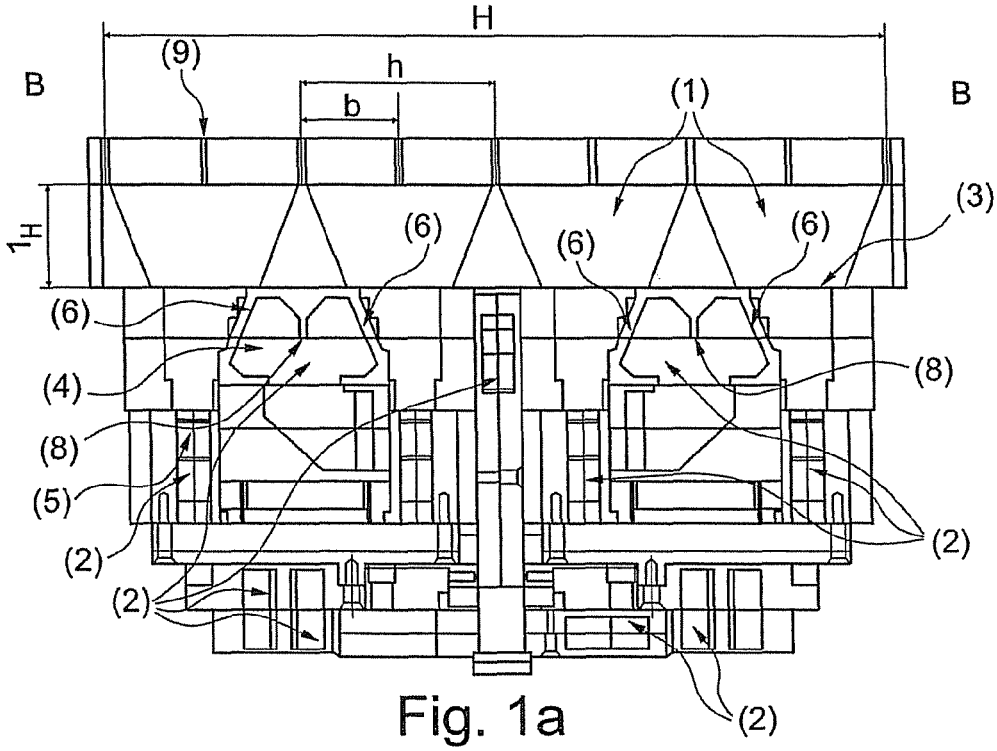
FIGS. 1*a-c* illustrate the design according to the invention of a horn array aperture and the schematic design of the feed networks.
Figure 1B:
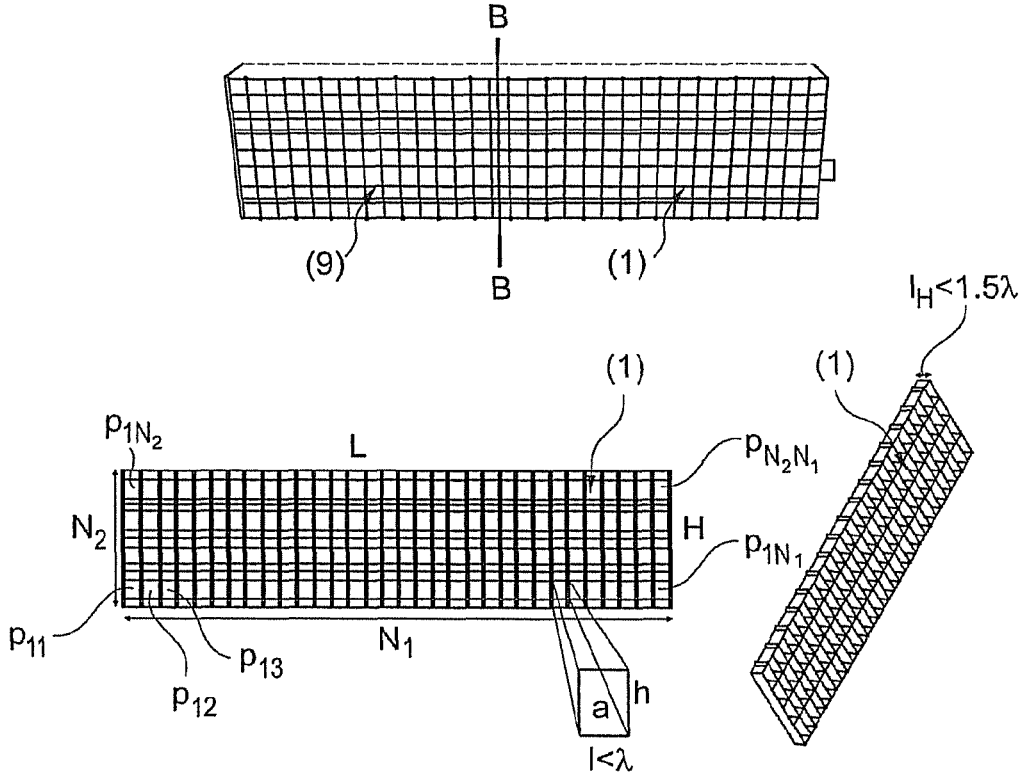
Figure 1C:
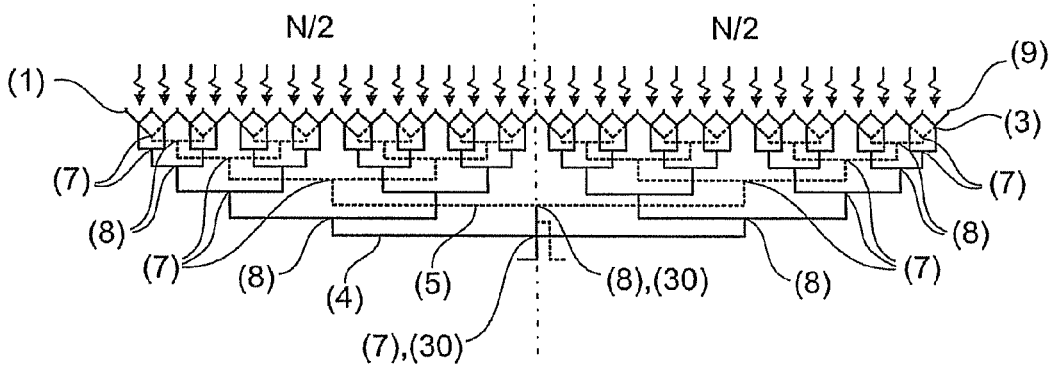

FIGS. 1*a-c* illustrate one preferred design of the antenna system according to the invention. The antenna for broadband satellite communication, in particular for mobile applications, consists of an array of primary horn antenna elements (1) which are connected to one another by a waveguide feed network (2), wherein the antenna consists of a number $N=N_1 \times N_2$ of primary horn antenna elements where $N_1>4\ N_2$, $N_1$ and $N_2$ are even integers, the total aperture area A of the antenna is $A=L \times H$, where $L \geqq 4\ H$ and $L<N_1\lambda$, where $\lambda$ is the minimum free-space wavelength of the electromagnetic wave to be transmitted or to be received, the primary horn antenna elements allow the reception and the transmission of two orthogonal linear-polarized electromagnetic waves in that they have a rectangular aperture area $a=l \times h$ where $l<h$ and $l<\lambda$, and each have an approximately square output (3), where $L=N_1\ l$, $H=N_2\ h$ and $A=N_1 \times N_2 \times l \times h=L \times H$, and the primary horn antenna elements (1) are fed directly at their output (3) via rectangular waveguides (4, 5) such that one of the orthogonal linear polarizations is supplied and carried away parallel to the aperture area, and the other of the orthogonal linear polarizations is supplied and carried away via a waveguide septum (6) on a plane at right angles to the aperture area, the horns of the primary horn antenna elements are compressed and have a length $l_H<1.5\lambda$ at right angles to the aperture area, the waveguide feed network (2) consists of a feed network for one of the two orthogonal linear polarizations (4) and a feed network, separate from the former, for the other of the two orthogonal linear polarizations (5), each of the two feed networks is in the form of a binary tree with binary E- and H-power dividers (7, 8), such that the respective last power divider on the lowest level of the binary tree combines the powers of two half-apertures, in each case with N/2 primary horn antenna elements, for each of the two orthogonal polarizations, separately and symmetrically, the aperture configuration of the antenna in each case approximately follows the relationship:

$$p_{1,j}<p_{2,j}<p_{3,j}<\ldots<p_{k,j}=p_{k+1,j}=p_{k+2,j}=\ldots=p_{k+m,j}>p_{k+m+1,j}<p_{k+m+2,j}<p_{k+m+3,j}>\ldots>p_{2k+m,j}$$

where k and m are integers and $2k+m=N_1$, and the powers $p_{i,j}$, $i=1\ldots N_1$, $j=1\ldots N_2$, denote the power contributions of the individual primary horn antenna elements, the aperture configuration is implemented by symmetrical and asymmetric binary E- and H-power dividers (7, 8) in each of the two feed networks for each of the two orthogonal polarizations, and the entire aperture area is covered by a phase equalization grid (9), where the meshes (10) of the phase equalization grid have a square dimension with an edge length b, and in each case, approximately, b=l, h=2 b and b<λ, such that, in the direction $N_1$, the webs of the grid lie above the abutting edge of two adjacent horn antenna elements and, in the direction $N_2$, the webs of the grid are each located approximately precisely at the center of the aperture area of the individual horn antenna elements.

The dimensioning of the horn antenna element array with a number $N=N_1\times N_2$ of primary horn antenna elements, where $N_1>4\,N_2$ and $N_1$ and $N_2$ are even integers, results in a rectangular antenna aperture which satisfies the requirements for as small a height as possible in mobile, in particular aeronautical, use. Furthermore, this dimensioning rule ensures that, when the antenna is rotated about the main beam axis, the widening of the main lobe, which is necessarily associated with the rotation, remains small within the angle range ±35°, which is important for this application. The widening in the Ku transmission band (14 GHz-14.5 GHz), by way of example, is only a few tenths of a degree with an aspect ratio of 4:1.

The angle range for the geographic skew of ±35° is therefore of particular importance, because then, in Ku band, for example, the entire North-American continent can be covered by just one satellite. This leads to a considerable reduction in the provision costs for a corresponding service.

If $N_1$ and $N_2$ are even numbers, then the horn antenna element array can be fed efficiently with a supply network which is binary in both directions.

The dimensioning rule for the length L of the horn antenna element array, $L<N_1\lambda$, ensures that no parasitic sidelobes occur in the azimuth direction, produced by an excessively great distance between the beam centers of the primary horn antenna elements. In this case, the wavelength λ must be the shortest of the wavelengths which occur during transmission operation. In Ku band transmission operation this is, for example, the wavelength for 14.5 GHz, as a result of which λ≈2.07 cm. Transmission operation permitted in accordance with the regulations is possible only by suppression of parasitic sidelobes.

Figure 2:
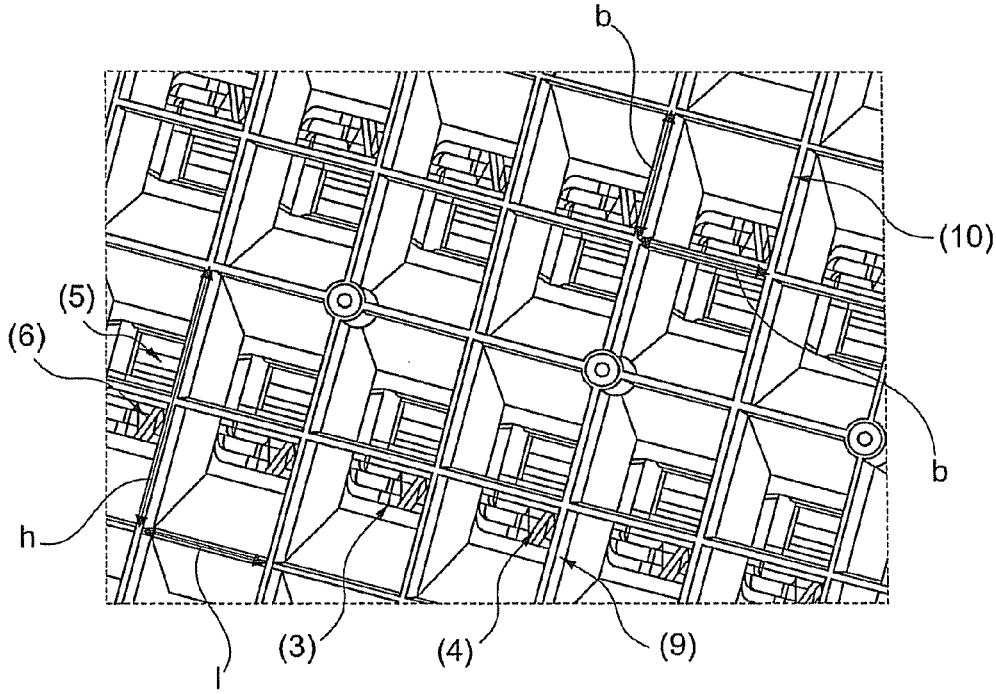
FIG. 2 shows the detailed design of the aperture surface.
Figure 3A:
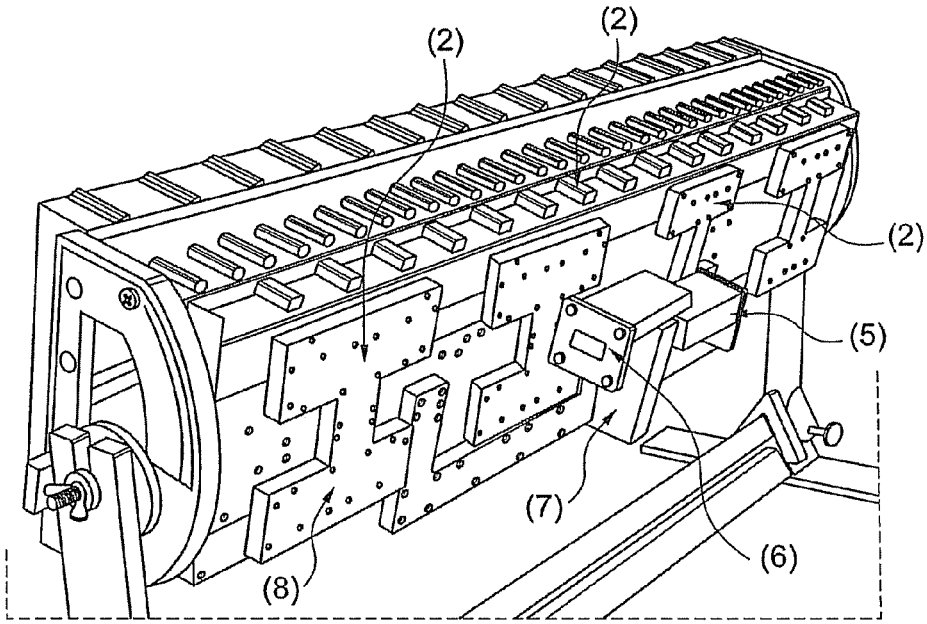
FIGS. 3*a-d* show the rear face of an antenna according to the invention and the detailed design of the horn antenna element array with the feed networks for two orthogonal linear polarizations.
Figure 3B:
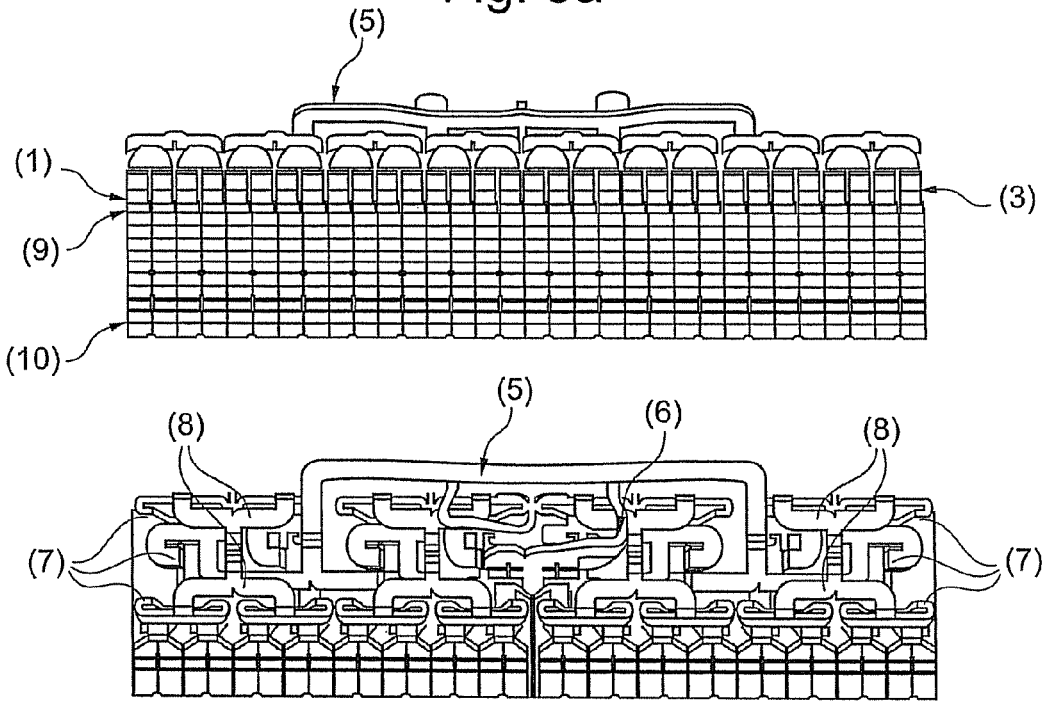
Figure 3C:
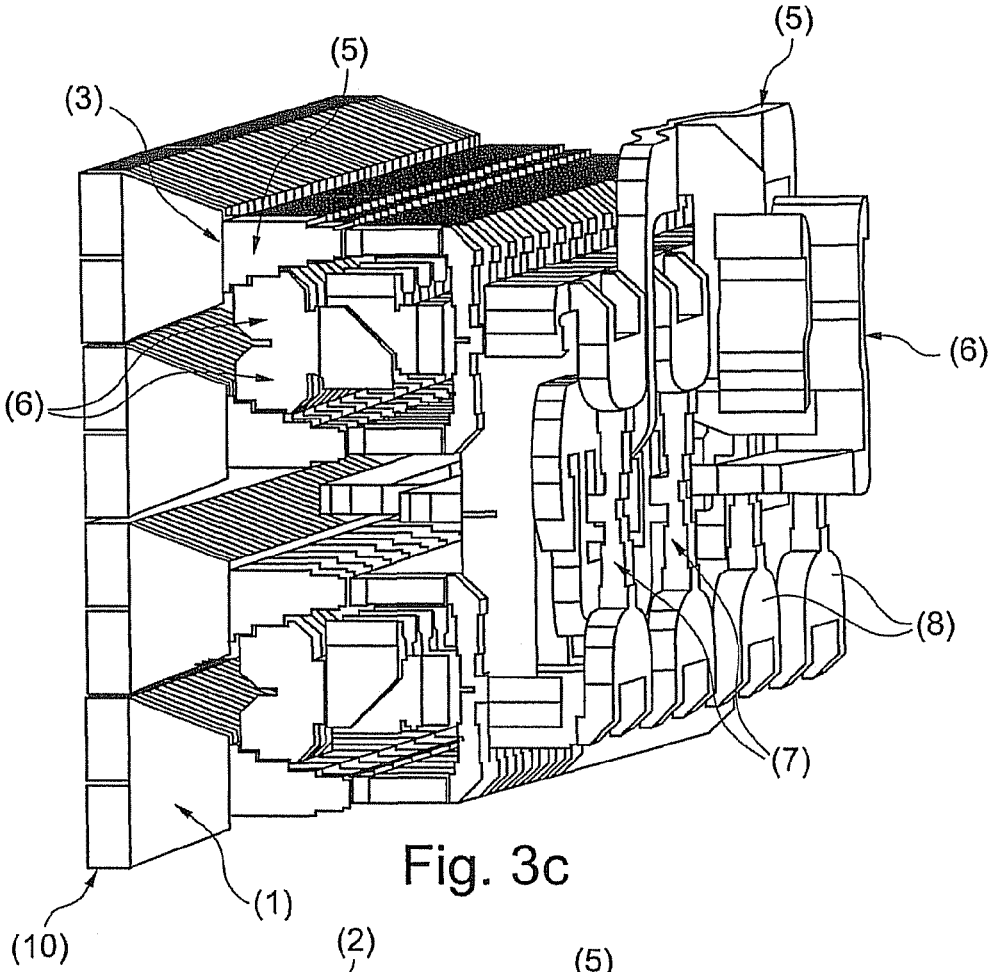
Figure 3D:
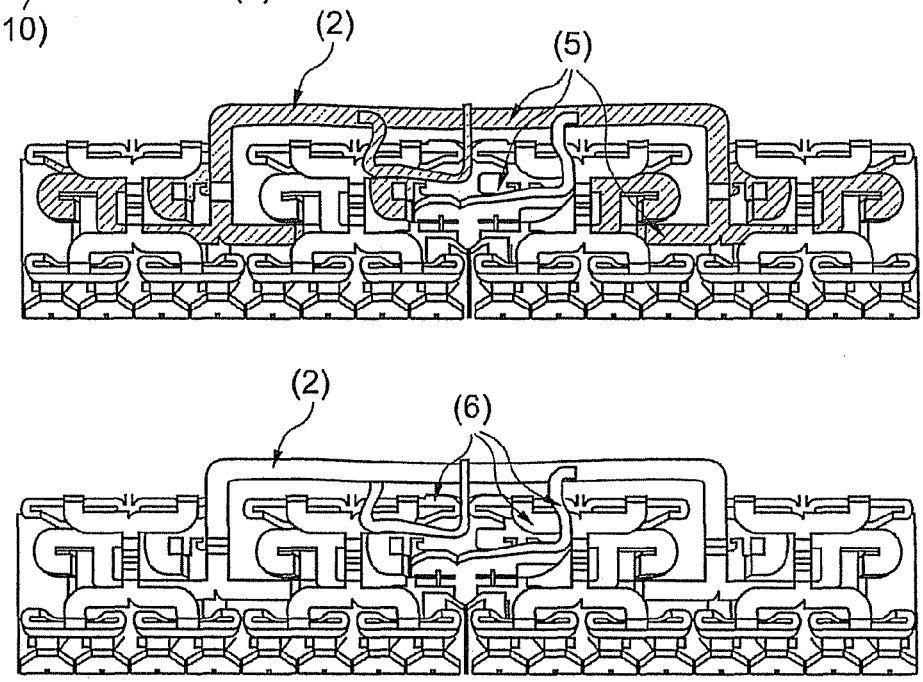

As is illustrated in FIG. 1*b* and FIG. 2, the primary horn antenna elements have a rectangular aperture area a, where a=l×h and l<h. The horn antenna element array is then designed in accordance with the rules $L=N_1\,l$, $H=N_2\,h$, and $A=N_1\times N_2\times l\times h=L\times H$, where A denotes the overall aperture area of the array. The apertures areas a of the primary horn antenna elements in the azimuth and elevation directions are therefore located close to one another, with their short edges aligned in the azimuth direction, and their long edges aligned in the elevation direction. If l<λ, this means that no parasitic sidelobes can occur in the azimuth direction when the horn configuration is dense. If, for example $l<\lambda_{max}$ and $l\approx\lambda_{max}\approx 2.07$ cm are chosen for Ku band transmission operation in the frequency band 14 GHz-14.5 GHz, then, with a choice according to the invention of h=2 l and $N_1>4\,N_2$, this results in a horn antenna element array of minimal size, which makes it possible to comply with the regulatory requirements. If, for example, the regulations require a 2° 3 dB width $\Delta_{3dB}$ for the main lobe in azimuth, then this results in a minimum number $N_{1,min}=26$ using the known approximation formula $\Delta_{3dB}=51°/L_\lambda$ (for example J. D. Kraus and R. J. Marhefka, "Antennas: for all Applications", 3rd Ed., McGraw-Hill series in electrical engineering, 2002, p. 374) where $L_\lambda=L/\lambda_{max}=N_{1,min}$. Then, $N_{2,min}\leqq 4$ for the minimum number of $N_2$, $N_{2,min}$, in accordance with the requirement that $N_1$ and $N_2$ must be even integers.

If the rule from claim 1 is now additionally used, by the feed network being in the form of a binary tree, then this results in a horn antenna element array for which $N_1=32$ and $N_2=4$, that is to say L≈64 cm and H≈16 cm. If the aperture configuration is now chosen according to the invention by means of symmetrical and asymmetric binary E- and H-power dividers, then the antenna diagram can comply with the regulatory requirements.

The dimensions of the primary horn antenna element furthermore ensure that they can have a square output, which supports two orthogonal linear polarizations. The square output (3) is fed by two rectangular waveguides lying on orthogonal planes with respect to one another. This geometry ensures effective polarization separation. Furthermore, the feed waveguide which lies on a plane at right angles to the aperture plane is provided with a waveguide septum (6) which prevents parasitic migration of the orthogonal polarization into this waveguide branch. The junction between the square output (3) of the primary horn antenna element and the input lying on the aperture plane of the rectangular waveguide for one linear polarization is typically designed to be stepped. This can likewise improve the polarization separation, and can widen the bandwidth. FIG. 2 illustrates one typical embodiment of the signal output from the primary horn antenna elements.

In order to keep the dimensions of the horn array as small as possible, the horns of the primary horn antenna elements are compressed in the beam direction. Their length at right angles to the aperture area is only $l_H<1.5\lambda$. This length is very much less than the length which would result in accordance with the known dimensioning rules for horn apertures and, without a phase equalization grid, leads to a significant impedance mismatch to the free-space wave, and therefore to considerable reflection losses. However, if the aperture is provided with a phase equalization grid according to the invention, then the horns may have dimensions according to the invention, without significant losses occurring. This leads to a considerable reduction in the size of the overall antenna. With antennas according to the invention, the phase equalization grid therefore not only has the object of homogenizing the phase shading of the aperture, but is also used for matching the impedance of the primary horn antenna elements to the free-space wave impedance.

A separate feed network is provided for each of the two orthogonal polarizations, in order to achieve the greatest possible polarization separation and the greatest possible instantaneous bandwidth. Furthermore, separate feeding directly from the horn outlet has the advantage that the two linear orthogonal polarizations can be processed completely separately, and that high-precision phase matching can be carried out. This is necessary in order to make it possible to achieve the typical accuracy, required for polarization tracking, of <1° over the entire instantaneous bandwidth, of typically more than 3 GHz. The separation between the transmission band and the reception band is also made easier by means of appropriate frequency diplexers.

Figure 4A:
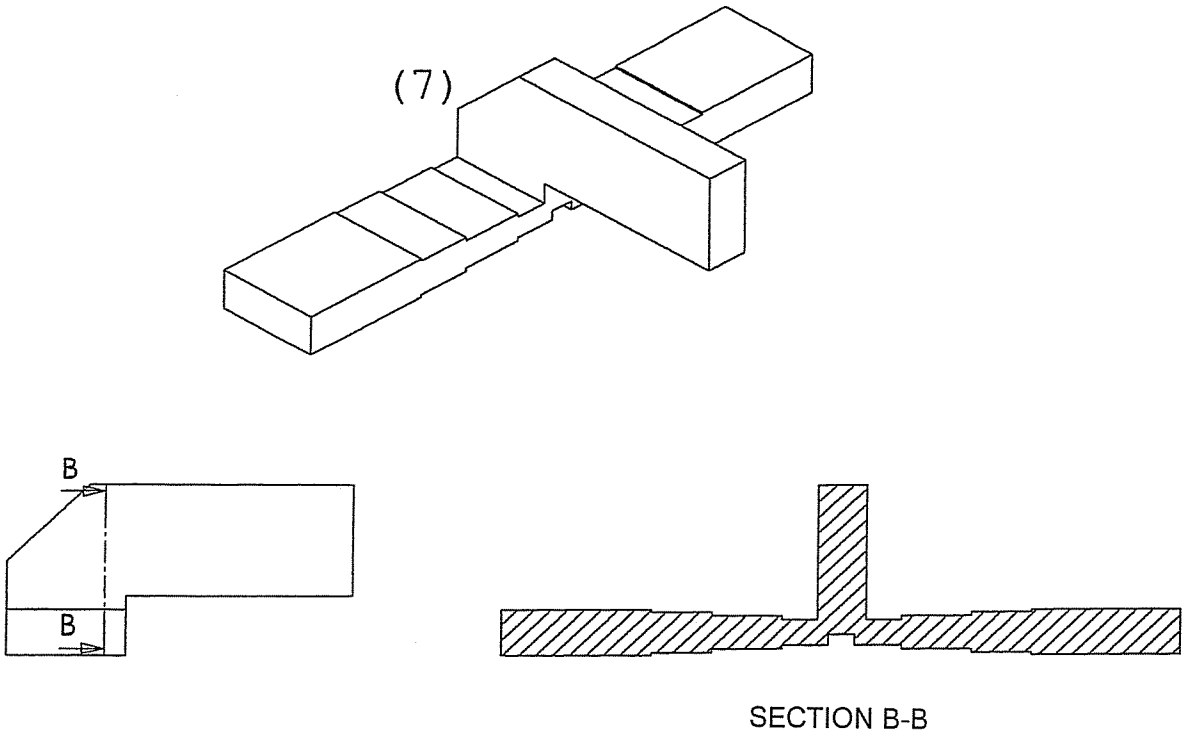
FIGS. 4*a-b* illustrate, by way of example, an E-field divider and an H-field divider for the feed networks.
Figure 4B:
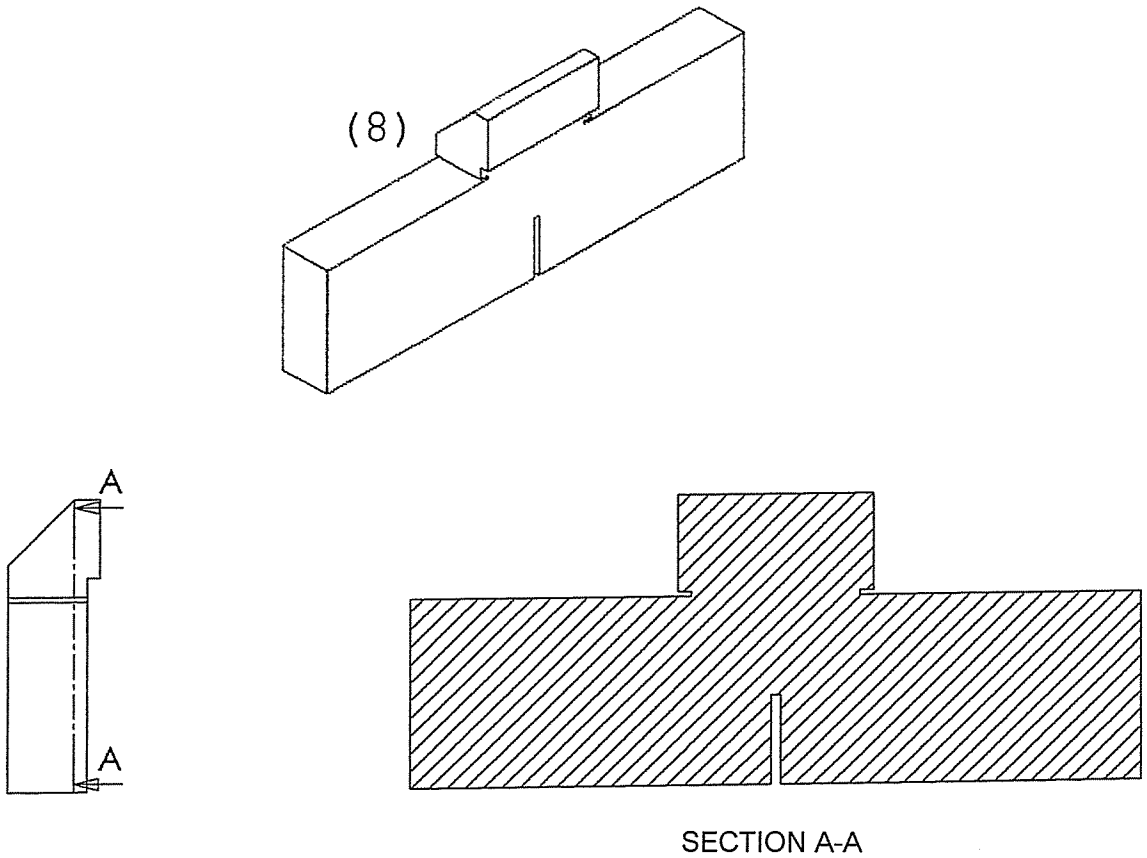

The configuration of the feed networks as binary trees, as illustrated schematically in FIG. 1*c*, makes it possible to use high-precision binary symmetrical and asymmetric E-field and H-field power dividers (7, 8), as illustrated, by way of example, in FIG. 4*a* and FIG. 4*b*. This high precision is necessary in order to achieve a virtually identical frequency response for both polarizations over the entire instantaneous bandwidth, as is required in order to make it possible to achieve the necessary precision for polarization tracking. By virtue of the design, high-efficiency phase matching over the entire instantaneous bandwidth can then be achieved by a suitable combination of waveguide pieces and coaxial cable pieces. Furthermore, this has the advantage that the amplitude configuration and phase configuration of the aperture can be set very precisely. This is necessary in order to make it possible to comply with the regulatory envelope reliably over the entire required transmission bandwidth of, typically, more than 500 MHz. It has been found that, in contrast to multiple power dividers, production-dependent tolerances in binary structures are typically averaged out for relatively large feeding structures. The waveguides (2) in the feed networks have dimensions for both polarizations, such that, on the one hand, this results in waves being carried with losses which are as low as possible over the entire instantaneous bandwidth, while on the other hand minimizing the physical space required, by virtue of a high integration density. For example, waveguides are therefore used in the Ku band, whose aspect ratio is considerably less than the standard ratio of 1:2. In the embodiment illustrated in FIG. 1*a*, the waveguides (2) have an aspect ratio of only 6.5:16. It has been found that this is sufficient to cover the entire instantaneous bandwidth of 10.7 GHz-12.75 GHz and 13.75 GHz-14.5 GHz. In comparison to waveguides with standard dimensions, this results in a significant volume reduction for the feed networks, of about 20%, and a corresponding reduction in weight. For example, the embodiment for Ku band as illustrated in FIGS. 3*a-d* has an overall depth (extent at right angles to the aperture plane) of only about 15 cm, which is a major advantage particularly for aeronautical applications.

It is envisaged that the feed networks be designed such that, at the lowest level, the power divider combines the signals of the two half-apertures using in each case N/2 primary horn antenna elements. This has the advantage that this power divider can also be designed as a combined E-field and H-field divider. This allows not only the sum signal of the two half-apertures but also the difference signal to be tapped off directly at the aperture output. If the difference signal is appropriately processed, this allows high-precision alignment of the antenna with the target satellite. For Ku band transmission operation in the USA, for example, the standard CFR 25.222 requires an alignment accuracy with the target satellite of <0.2°. This is possible only over brief time periods with conventional "open loop" readjustment methods based on position data (for example by GPS and/or inertial detectors). Transmission operation must then be interrupted, and the antenna must be realigned with the aid of the received signal.

If, in contrast, the aperture is designed such that it can provide the difference signal, then closed-loop tracking can be used to achieve accuracies which are <<0.2° all the time.

FIG. 1*c* shows the schematic design of the two feed networks for the two orthogonal linear polarizations. The two polarizations are separated directly at the output (3) of the primary horn antenna elements (1), and are supplied and carried away in two separate feed networks (4) (solid lines) and (5) (dotted lines). Both feed networks are in the form of binary trees with E-field dividers (7) and H-field dividers (8). At the lowest level, the signals from N/2 primary horn antenna elements are in each case combined symmetrically. The divider at the lowest level may be in the form of a combined E-field and H-field divider (30) in order to measure the difference signal of the two aperture halves for both polarizations.

Figure 5A:
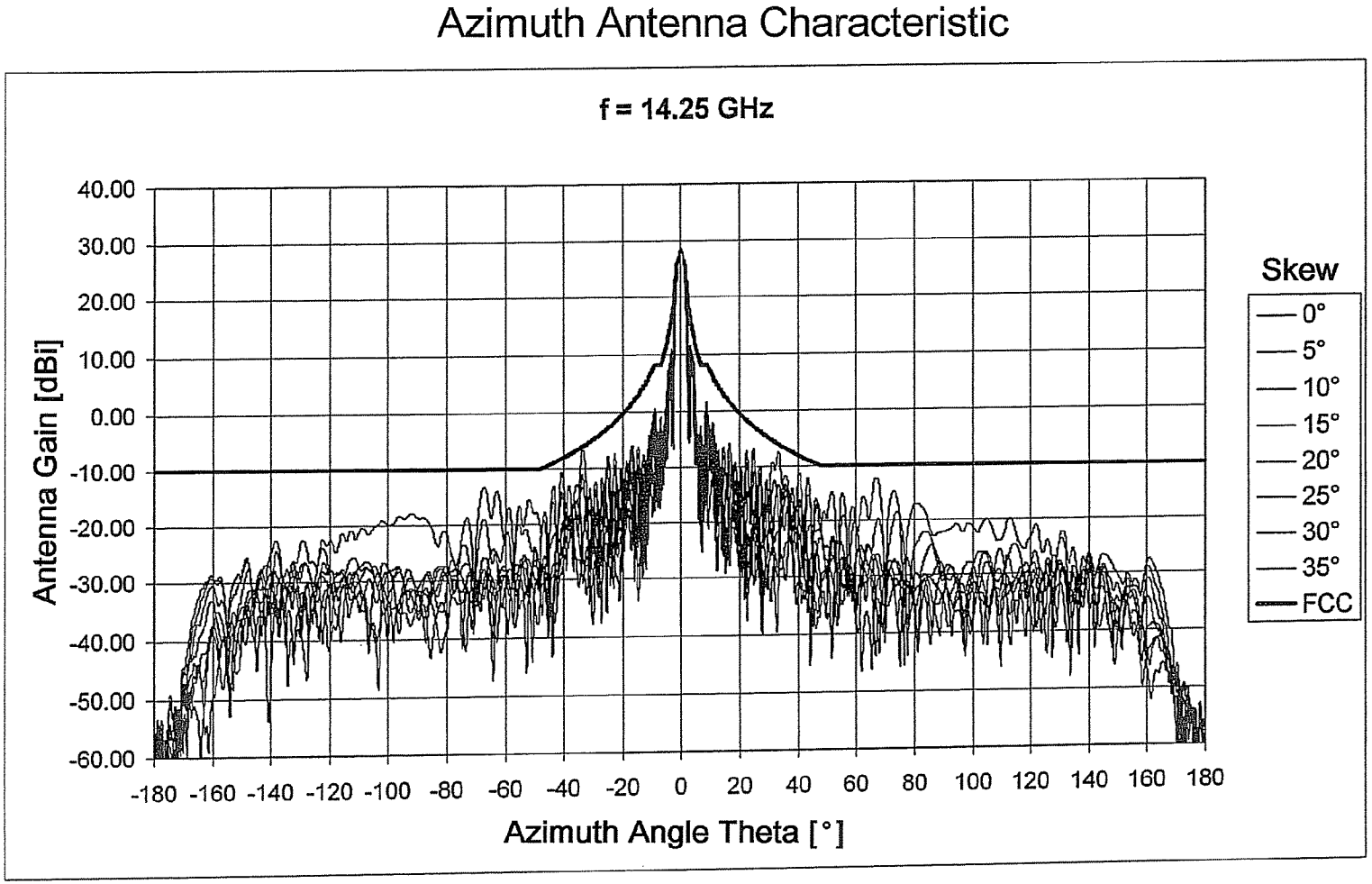
FIGS. 5*a-b* show a typical antenna diagram for an antenna according to the invention.
Figure 5B:
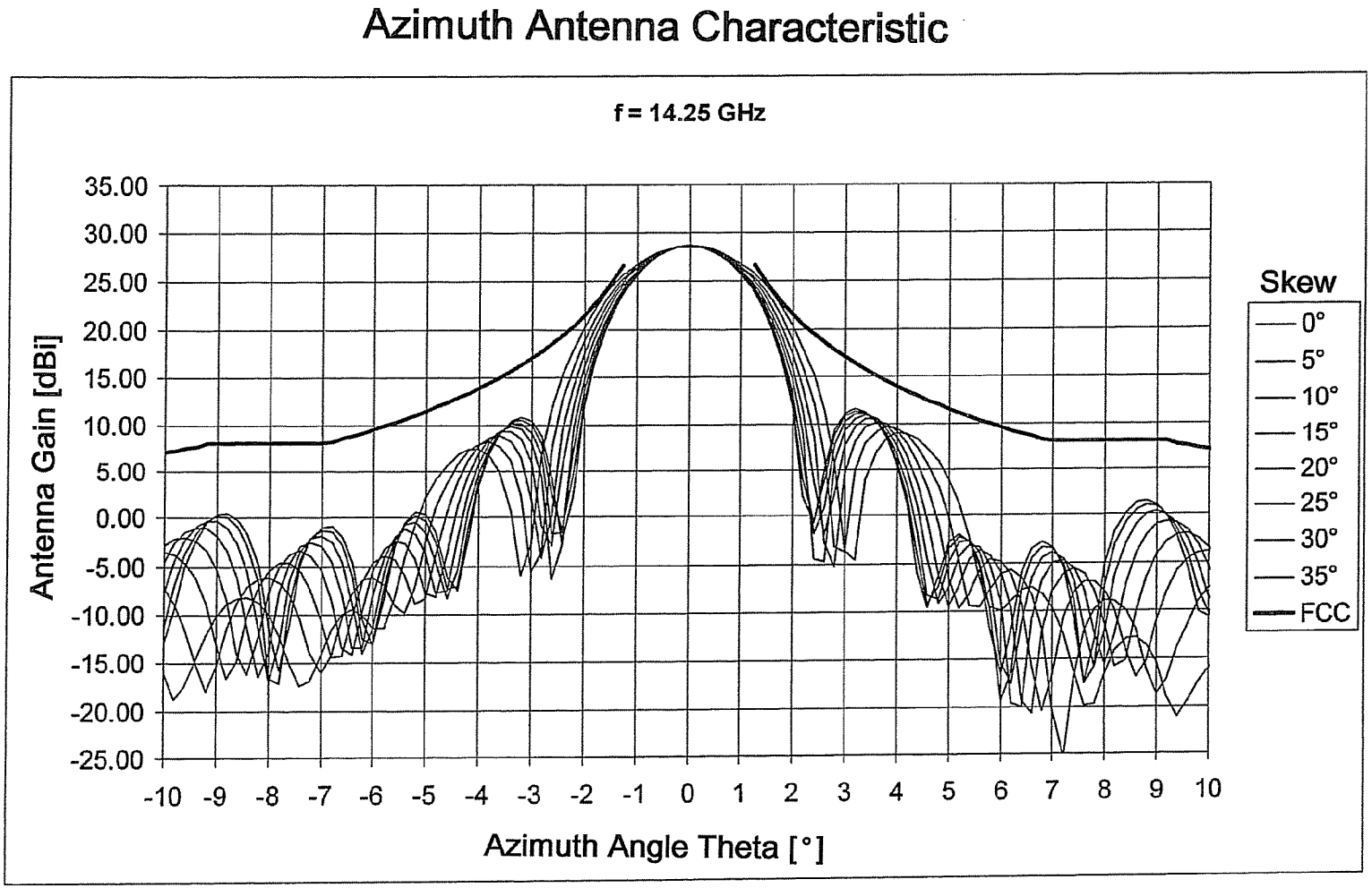

The invention furthermore envisages that the aperture be provided with hyperbolic amplitude configuration, which in all cases approximately satisfies the relationship $$p_{1,j}<p_{2,j}<p_{3,j}<\ldots<p_{k,j}=p_{k+1,j}=p_{k+2,j}=\ldots=p_{k+m,j}>p_{k+m+1,j}>p_{k+m+2,j}>p_{k+m+3,j}>\ldots>p_{2k+m,j}$$

where k and m are integers and $2k+m=N_1$, and the powers $P_{i,j,\ i=}1\ldots N_1, j=1\ldots N_2$ denote the power contributions of the individual primary horn antenna elements. It has been found that amplitude configurations which satisfy this relationship—provided that all the other features according to the invention are present—produce antenna diagrams which can comply with the typical regulatory envelopes (for example defined in CFR 25.209 and ETSI EN 302 186). This class of amplitude configuration, together with the dimensioning rules for the horn antenna element array, the individual primary horn antenna elements and the phase equalization grid, furthermore has the characteristic that no parasitic grating lobes occur as the geographic skew angle increases, and, instead, the level of the sidelobes in the azimuth direction decreases over the entire instantaneous bandwidth. This is a major advantage of arrangements according to the invention over previously known arrangements. The effect is illustrated in FIGS. 5*a* and 5*b* for a typical embodiment and for a frequency in the Ku transmission band (14.25 GHz). The angle theta in this case denotes the angle along the tangent on the Clarke orbit at the point where the geostationary satellite is located, and the skew angle denotes the rotation angle of the aperture at right angles to the beam direction, when the antenna is pointing at this satellite. The bold curve ("FCC") marks the regulatory envelope according to CFR 25.209, which must not be exceeded by the antenna gain. FIG. 5*a* shows the angle range from −180° to +180°, and FIG. 5*b* shows the region around the main lobe.

The aperture configuration is provided by symmetrical and asymmetric binary E- and H-power dividers (7, 8) in each of the two feed networks for each of the two orthogonal polarizations, and is therefore effective over the entire instantaneous bandwidth. This has the advantage that a very high level of directionality is achieved in the reception band as well, and parasitic input radiation of signals from adjacent satellites is greatly reduced. FIG. 1*c* shows one typical embodiment of the feed networks. Typical embodiments of the E-field dividers (7) and H-field dividers (8) are illustrated in FIGS. 4*a* and 4*b*.

As is illustrated in FIGS. 1*a*, 1*b* and 2, the invention also provides for the entire aperture area to be covered by a phase equalization grid (9), where the meshes (10) of the phase equalization grid have a square dimension with an edge length b, and in each case, approximately, b=l, h=2 b and b<λ, such that, in the direction $N_1$, the webs of the grid lie above the abutting edge of two adjacent horn antenna elements and, in the direction $N_2$, the webs of the grid are each located approximately precisely at the center of the aperture area of the individual horn antenna elements (1). The dimensions b=l and therefore b<λ ensure that the phase equalization grid follows the periodicity of the horn antenna element array in the azimuth direction, and that no additional parasitic sidelobes therefore occur. In the elevation direction, the webs of the phase equalization grid subdivide the aperture areas of the primary horn antenna elements into two identical parts, as illustrated in FIG. 1*a*. This arrangement has the advantage that the phase configuration of the array is homogenized in both directions, and that no parasitic sidelobes which are dependent on phase correlation occur even when the aperture has rotated about the main beam direction. Since the grid has square cells, no distortion of the E-field and H-field vectors occurs even when a geographic skew is present, even when, as in the case of the arrangements according to the invention, the aperture areas of the primary horn antenna elements have an aspect ratio of 1:2. This makes it possible to halve the number of primary horn antenna elements required in the elevation direction, since they need not have any extent in this direction which is less than λ. The topological requirements for the feed networks are thus considerably simplified, and an additional volume and weight reduction is achieved.

The extent of the phase equalization grid (9) in the direction at right angles to the aperture area is typically between λ/4 and λ/2. This extent is governed by the extent $l_H$ of the horn funnels of the horn antenna elements which, according to the invention, is <1.5λ. The instantaneous bandwidth and the impedance matching to the free-space wave can be adjusted in accordance with the respective requirements by variation of both lengths. Arrangements according to the invention therefore have the advantage over arrays formed from unmodified horn antenna elements that an additional degree of freedom exists for the aperture design, and the antenna performance of the greatly shortened horns can thus be optimized for the available physical space.

Further advantageous embodiments of the invention will be described in the following text.

With regard to regulatory conformity and because of simpler manufacture, it is advantageous for the aperture configuration of the antenna to in each case approximately follow the relationship:

$$p_{1,j}<p_{2,j}<p_{3,j}<\ldots<p_{k,j}=p_{k+1,j}=p_{k+2,j}=\ldots=p_{k+m,j}>p_{k+m+1,j}>p_{k+m+2,j}>p_{k+m+3,j}>\ldots>p_{2k+m,j}$$

where k and m are integers and $m \geqq 2k$, $2k+m=N_1$ and, in each case approximately, $p_{i,j}=p_{2k+m+1-i,j}$ for $i=1 \ldots N_1/2$, and the powers $p_{i,j}$, $i=1 \ldots N_1$, $j=1 \ldots N_2$ denote the power contributions of the individual primary horn antenna elements. This class of trapezoidal amplitude configuration means that the number of asymmetric power dividers in the feed networks can be minimized, while nevertheless complying with the regulatory requirements. The networks can therefore be manufactured considerably more easily and to be considerably more tolerant to errors. By way of example, the above-mentioned example of an aperture for Ku band for which $N_1=32$ and $N_2=4$ results in m=16 and k=8, as a result of which, in principle, only 8 different asymmetric power dividers are required. This represents a considerable simplification. FIGS. 5*a* and 5*b* show one example of a measured antenna diagram for an antenna according to the invention with trapezoidal aperture shading.

A further manufacturing simplification can be achieved by the aperture configuration of the antenna in each case approximately satisfying the relationship $$p_{1,j}<p_{2,j}<p_{3,j}<\ldots<p_{k,j}=p_{k+1,j}=p_{k+2,j}=\ldots=p_{k+m,j}>p_{k+m+1,j}>p_{k+m+2,j}>p_{k+m+3,j}>\ldots>p_{2k+m,j}$$

where k and m are integers and $m \geqq 2k$, $2k+m=N_1$ and, in each case approximately, $p_{i,j}=P_{2k+m+1-i,j}$ for $i=1 \ldots N_1/2$, and the powers $p_{i,j}$, $i=1 \ldots N_1$, $j=1 \ldots N_2$ denote the power contributions of the individual primary horn antenna elements, and the powers $p_{i,j}$ to $p_{k,j}$ as well as the powers $p_{k+m,j}$ to $p_{2k+m,j}$ each being linearly dependent on one another, such that $p_{i,j}$ to $p_{k,j}$ and $p_{k+m,j}$ to $p_{2k+m,j}$ each at least approximately lie on a straight line, and the gradients of the two straight lines in any case differ approximately only by the mathematical sign.

Figure 6:
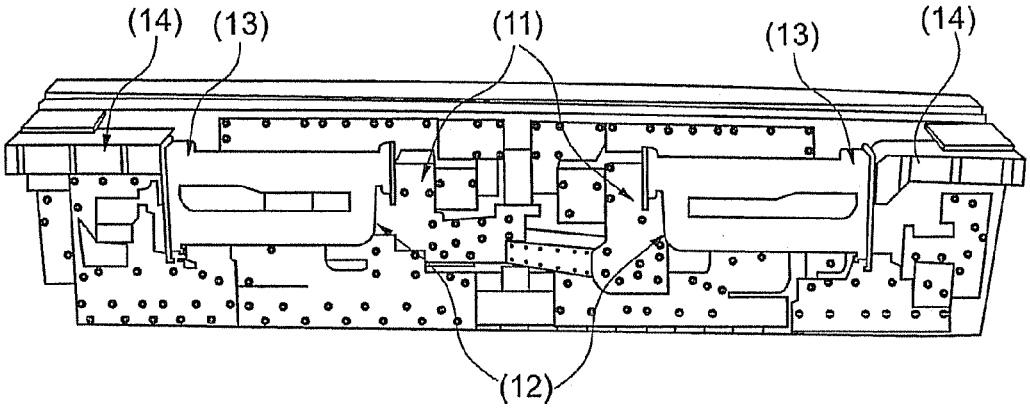
FIG. 6 shows the rear face of an antenna according to the invention, with frequency diplexers and amplifiers.

FIG. 6 illustrates a further advantageous embodiment. If the antenna is used simultaneously for transmission and for reception, then it is advantageous for the output of the feed network of each of the two orthogonal polarizations in each case to be connected by a waveguide (11) to a waveguide frequency diplexer (12), which separates the transmission frequency band from the reception frequency band, and for the reception frequency band output (13) of the two waveguide frequency diplexers (12) to be connected in each case to a low-noise amplifier (14). In this case, waveguide components are provided since these can have the lowest attenuation and the greatest isolation between the transmission and reception bands. The reception frequency band output is in each case connected to a low-noise amplifier, either directly or preferably by means of a waveguide, such that the parasitic noise power resulting from dissipative connections remains minimal.

Because of the low self-noise of antennas according to the invention, cooled low-noise amplifiers can advantageously be used here. The reception performance of the antenna can be increased further, in particular by thermoelectrically cooled low-noise amplifiers or actively or passively cryogenically cooled low-noise amplifiers.

Figure 7:
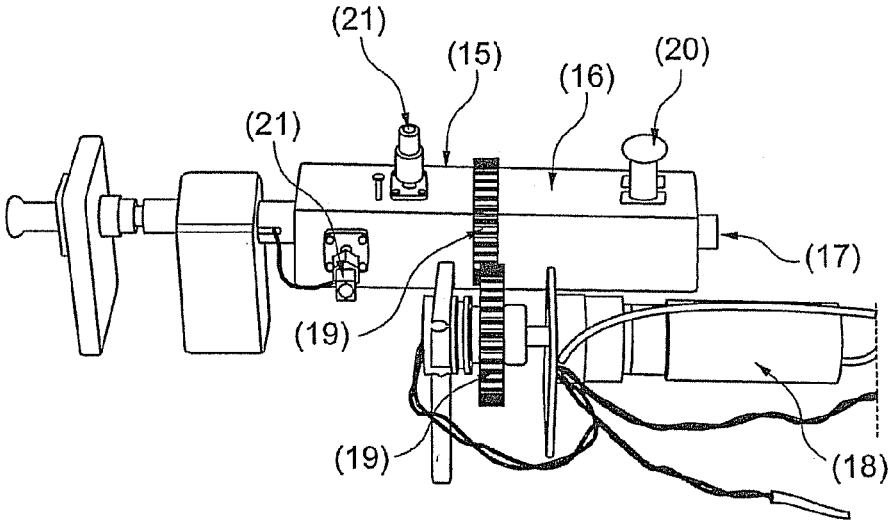
FIG. 7 illustrates a waveguide module according to the invention, for polarization tracking.
Figure 8:
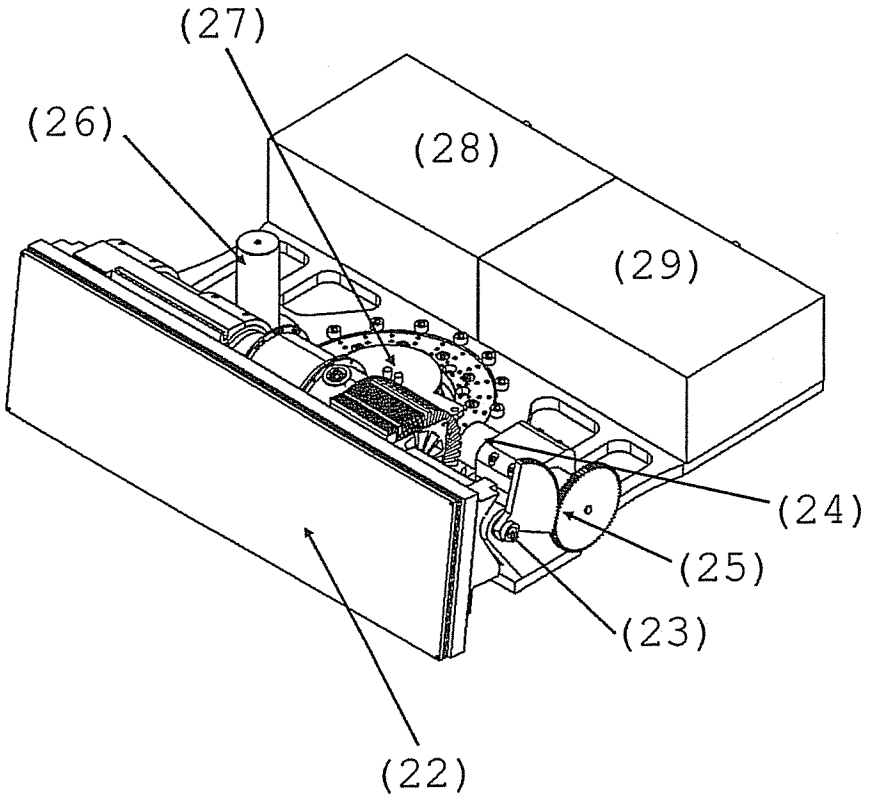
FIG. 8 shows an aeronautical antenna system with a two-axis positioner.

FIG. 7 illustrates one typical embodiment of a waveguide module for polarization tracking. In order to compensate for the geographic skew or other polarization rotations which are caused by corresponding movements of the antenna carrier, it is advantageous if the two orthogonally linear-polarized signals which are present at the two outputs of the feed networks and/or at the outputs of the waveguide frequency diplexers and/or at the outputs of the low-noise amplifiers are fed orthogonally into one or more waveguide modules which consist of two waveguide pieces (15, 16) which are connected to one another along their axis and can be rotated, driven by motors (18), with the aid of a gearbox (19), with respect to one another about the waveguide axis (17), such that, on the opposite side (21) of the waveguide modules to the feed points (20), linear-polarized signals whose polarization has been rotated with respect to the orthogonally linear-polarized signals fed in can be output, and the polarization of the incident waves can thus be reconstructed, or the polarization of the waves to be transmitted can be controlled.

If the antenna is used for reception and for transmission of signals in different frequency bands, which in some circumstances are well apart from one another, then it is advantageous for the antenna to be equipped with a waveguide module for polarization tracking for the transmission band, and with a waveguide module, which is separate from the former, for polarization tracking for the reception band. The two waveguide modules can then be tuned precisely to the appropriate band. This results in high-precision polarization tracking, making it possible to minimize the errors caused by frequency dispersion in the waveguides.

If the antenna is intended to be used not just for reception and for transmission of linear-polarized signals but also for reception and/or transmission of circular-polarized signals, then it is advantageous if the two orthogonally linear-polarized signals, which are present at the two outputs of the feed networks and/or at the outputs of the waveguide frequency diplexers and/or at the outputs of the low-noise amplifiers, are converted by one or more 90° hybrid couplers to orthogonal circular-polarized signals, such that the antenna can also be used to transmit and/or receive circular-polarized signals. If the transmitted and received signals are appropriately split, simultaneous operation is also possible with all four possible orthogonal polarizations (2×linear+2×circular), both during transmission operation and during simultaneous reception operation. An arrangement in accordance with the present invention therefore has the greatest possible variability.

Particularly for mobile applications, it is advantageous for the antenna to be fitted on the elevation axis of a two-axis positioner, and for the waveguide modules for compensating for polarization rotations and/or the 90° hybrid couplers for reconstruction of circular-polarized signals to be fitted on the azimuth platform of the positioner, and for the antenna and the waveguide modules and/or the 90° hybrid couplers to be connected to one another by means of flexible radio-frequency cables. This arrangement of aperture and RF modules reduces the required physical space and simplifies integration, particularly for aeronautical applications. FIG. 7 illustrates one typical arrangement with a two-axis positioner. The horn array aperture with a feed network (22) is mounted on the elevation axis (23), and can be aligned in the elevation direction with the aid of the elevation motor (24) and the elevation gearbox (25). The antenna can be rotated about the azimuth axis (27) with the aid of the azimuth motor (26). A radio-frequency rotary joint, typically with two channels, is integrated in the azimuth axis (27). The electronics boxes (28) and (29) typically contain the control electronics for the positioner as well as additional radio-frequency modules, for example modules as claimed in claim 4 for polarization tracking. In addition, the boxes (28) and (29) may contain the processing electronics for high-precision tracking of the antenna, such as the electronics for processing the difference signal and the sum signal of a combined E-field and H-field divider.

Because of the extreme environmental conditions to which fuselage-mounted aeronautical antennas, in particular, are subject, it may be advantageous if all or some of the components of the antenna are entirely or partially silver-plated or copper-plated, all or some of the components are soldered and/or welded and/or adhesively bonded to one another, the antenna, with the exception of the aperture area, is provided entirely or partially from the outside with a protective layer against the ingress of moisture, and a watertight film, through which radiofrequencies can pass, is introduced on the plane between the primary horns (1) and the phase equalization grid (9), or on the plane of the horn outputs (3), which film prevents the ingress of moisture into the primary horns and the waveguide feed network. Particularly for mobile applications, for weight reduction reasons, antennas according to the invention are typically composed of lightweight metals such as aluminum or metalized plastic materials. In order to increase the antenna efficiency, it is advantageous to plate these materials with silver or copper, since silver and copper have very high RF conductivity. In order to ensure the required RF shielding even in the event of extremely rapid temperature changes, it is advantageous to solder, to weld or to adhesively bond at least critical parts of the aperture, in which case electrically conductive adhesives are typically used for adhesive bonding. Furthermore, it may be necessary to protect the aperture against the ingress of moisture, in particular water condensation. Since it has been found that the phase equalization grid need not be galvanically connected to the primary horn antenna elements, it is advantageous to fit a required protective film between the plane of the primary horns and the phase equalization grid, or on the plane of the horn outputs (3). This also has the advantage of a very high level of mechanical robustness, even in the event of major changes in the environmental air pressure.

However, for protection against the ingress of moisture, a suitable material through which RF can pass can also be applied from the outside to the phase equalization grid. Suitable materials are, in particular, thin panels composed of closed-cell foams (for example polystyrene, Airex, etc.). These panels can be adhesively bonded to the surface of the phase equalization grid by means of suitable flexible or viscoplastic adhesives, and/or can be screwed to the surface, thus reliably preventing the ingress of moisture or other undesirable substances into the antenna. A hydrophobic and/or fungicidal application to the surface of the protective material is also advantageous, since this prevents the undesirable accumulation of biological organisms ("biological slime", mold) which can negatively influence the radio-frequency characteristics. It is also possible to directly close the openings in the phase equalization grid with foam.

Furthermore, particularly for aeronautical applications, it may be advantageous to provide the feed network with ventilation openings. Such ventilation openings can prevent water condensation from accumulating in the interior of the antenna, which can lead to the radio-frequency characteristics of the antenna being adversely affected. In this case, the ventilation openings are preferably incorporated on the long edge of the waveguides of the feed network, since only small radio-frequency currents flow here. The size of the ventilation openings is typically very much smaller than the wavelength for which the antenna is designed. However, the ventilation openings can also be incorporated in the protective film of the phase equalization grid and/or in the material covering the phase equalization grid, in which case larger openings can also be provided here. In order to prevent the ingress of dirt or other undesirable substances such as oil, it may furthermore be advantageous to provide the ventilation openings with membranes through which only water vapor can pass (for example oleophobic gore membranes).

Figure 9:
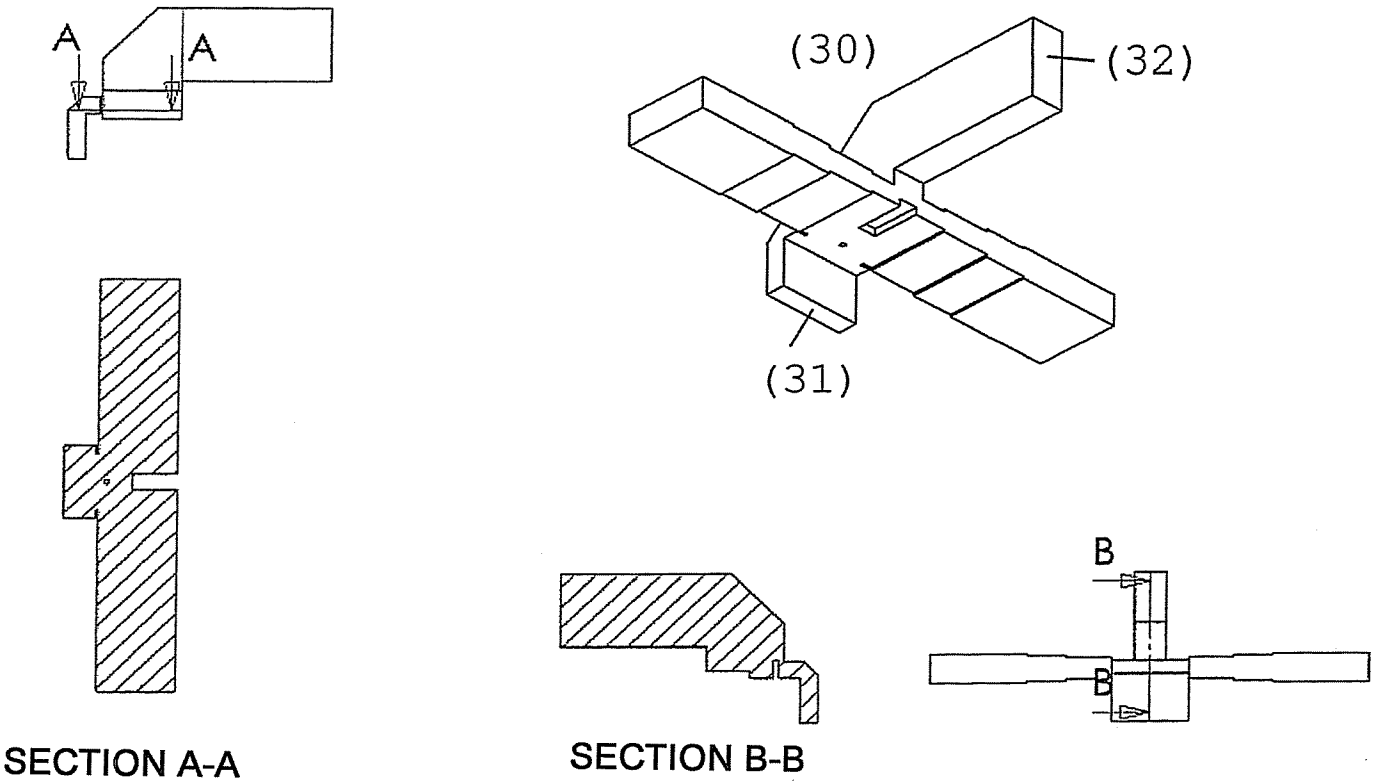
FIG. 9 illustrates a combined E-field and H-field divider, which can be used to track the antenna with high precision.

FIG. 9 illustrates one typical embodiment of a combined E-field and H-field divider, which can be used for high-precision tracking of the antenna. One advantageous embodiment of the antenna is characterized in that the last waveguide power divider of each of the two feed networks (4, 5), which combines the signals from the two aperture halves with in each case N/2 primary horn antenna elements, is designed as a combined E- and H-divider (30) such that both the sum signal (31) of the two symmetrical aperture halves and the difference signal (32) of the two symmetrical aperture halves are applied to this waveguide four-port network, and both the sum signal and the difference signal can be passed out separately for each of the two orthogonal polarizations. Combined E-field and H-field dividers, so-called "magic tees" are four-port elements which, because of their geometric characteristics, provide both the sum signal of two supplied signals, and the difference signal. Because of the binary configuration of the feed networks, it is possible with horn array apertures according to the invention to install a "magic tee" instead of the last binary power divider. The difference signal can then be used either on its own or together with the sum signal for high-precision alignment of the antenna with the target satellites. Since the difference signal disappears when aligned exactly, and the sum signal is a maximum when aligned exactly, the quotient, for example, of the signal powers $P_{difference}/P_{sum}$ has an extremely pronounced minimum (a so-called "null") when aligned exactly. In the event of errors from the exact alignment, the value of the quotient rises sharply, and can be used for precise and rapid readjustment of the antenna. Furthermore, the phase of the RF signal at the difference port (32) has a zero crossing when aligned exactly, as a result of which the mathematical sign of the phase angle indicates the direction in which the antenna must be readjusted. Since, in principle, high-precision readjustment for satellite antennas need be carried out only along the Clarke orbit—the azimuth direction—it is sufficient to divide the aperture into two halves in the azimuth direction. Open-loop readjustment with the aid of position data and/or inertial detector data is typically adequate in the elevation direction.

If the last power divider in the feed networks is in the form of a combined E-field and H-field divider (30), then it is advantageous if the difference port (32) of the combined E- and H-divider is equipped with a transmission band stop filter, which prevents the transmission signals from entering the difference branch, and the difference port (32) is connected via the transmission band stop filter to a low-noise amplifier. Since only the received signal need be used for high-precision readjustment of the antenna with the aid of the signal from the difference port, the low-noise amplifier which amplifies this signal can be efficiently protected by a transmission-band stop filter against being overdriven by the typically very strong transmitted signal. A waveguide stop filter is typically used for this purpose, since this class of component has only a very low attenuation. It is also advantageous for the low-noise amplifier to be connected directly to the transmission-band stop filter, preferably likewise by waveguides, since this makes it possible to minimize the signal loss. If the received signal is strong enough, embodiments are then, however, also feasible in which the low-noise amplifier is connected to the transmission-band stop filter by a radio-frequency cable, for example a coaxial line.

Particularly for mobile applications of the antenna, it is advantageous if the difference signals and/or some of the sum signals of the two symmetrical aperture halves are passed to processing electronics, which evaluate the strength and/or the phase angle of the difference signals and/or of the sum signals and transfers/transfer them/this to the control electronics of the antenna positioner, such that the control electronics can readjust the antenna such that the difference signal is a minimum, and the antenna thus remains aligned with the target satellites when the antenna carrier is moving relative to the target satellite. By virtue of the design, the antenna is optimally aligned with the target satellite when the received signal at the difference port of the combined E-field and H-field divider is a minimum. This optimality criterion can therefore be used in a simple manner for high-precision readjustment of the antenna when the antenna carrier is moving, by being processed by a suitable electronics unit, and being passed to the control system for the antenna positioning system. Since the difference signal is available all the time, very high sampling rates are possible, and therefore very rapid readjustment, even when the antenna carrier is moving very fast. Since the phase of the difference signal has a rapid zero crossing when optimally aligned with the target satellite, it is advantageous to also evaluate the phase angle of the difference signal, and to use said phase angle for readjustment. This typically allows even greater readjustment precision to be achieved than if only the strength of the difference signal were used. Since the antenna diagram of the difference port has two main lobes, which in the worst case can point at adjacent satellites, it is also advantageous to compare the strength and/or the phase angle of the difference signal with the sum signal, in order to preclude parasitic interference from adjacent satellites during readjustment. In principle, parasitic interference terms in the difference signal can be eliminated by appropriate processing of the sum signal, because the antenna diagram of the sum port has only a single, well-defined main lobe. By way of example, this can be done by projecting the difference signal, matched in phase, onto the sum signal.

In order to readjust the antenna with high precision, it is in principle possible to use both beacon signals of the satellite and normal transponder signals. In this case, a satellite beacon typically consists of a narrowband (<1 kHz) signal similar to a continuous wave, while a normal transponder typically transmits a broadband signal (in the Ku band, for example 30 MHz), to which information content is supplied by phase coding (for example QPSK). In both cases, it may be advantageous to increase the signal-to-noise ratio of the difference port signal and/or of the sum port signal by restricting the noise bandwidth. The processing of radio-frequency signals is also made easier by the processing electronics for the difference signals and/or the sum signals containing one or more fixed frequency mixers and/or one or more controllable variable-frequency mixers and one or more frequency filters, by means of which the difference signal or a portion of the difference signal, and/or the sum signal or a portion of the sum signal, can be converted to a defined baseband, and can be processed there. The frequency range or transponder used for readjustment can be operated specifically by the use of controllable variable-frequency mixers ("frequency synthesizers").

In the case of satellite signals of suitable strength, the difference signal and the sum signal can be evaluated directly in baseband. For this purpose, it is advantageous if the strength of the difference signal and/or of the sum signal in baseband is measured by a suitable electronic circuit, and is transferred to the control electronics of the antenna positioner. In this case, it is possible to use standard electronic components, such as suitable amplifiers or power detectors, which are available at low cost for typical basebands in the MHz range.

In the case of weak satellite signals or poor satellite configurations, it may be advantageous if the difference signal and/or the sum signal is digitized in baseband by an analog/digital converter, and is passed to a processor which has suitable evaluation methods for determining the strength and/or the phase angle of the difference signal and/or of the sum signal and for transferring this information to the control electronics of the antenna positioner. Digitizing the signals allows software-controlled evaluation and therefore flexible matching to the respective circumstances. By way of example, the processor may in this case consist of a specially programmed FPGA or a simple freely programmable computation unit. By way of example, software-implemented controllable filters can be used to improve the signal quality, and allow the noise bandwidth to be optimized.

If the antenna signals are converted to a baseband, are digitized and are passed to a processor for high-precision readjustment purposes, then it is advantageous in particular for aeronautical applications, in which the antenna carrier (for example the aircraft) can move at very high speed, for the processor to have an evaluation method by means of which it is possible to compensate for the Doppler frequency shift which occurs in the difference signal and/or in the sum signal when the antenna carrier is moving fast. In contrast to the electronic implementation of Doppler tracking electronics, software-implemented tracking can be implemented in a relatively simple form in a suitable processor, if the signals are already in digitized form. Since the maximum Doppler shift can be calculated via the maximum speed of the antenna carrier, it is possible to configure a software-implemented filter appropriately. The instantaneous frequency of the signal can then be determined, for example with the aid of FFT (Fast Fourier Transformation), the noise bandwidth can be set as appropriate, and the strength of the signal can be measured.

Since, in mobile and in particular aeronautical applications, the antenna aperture typically cannot be rotated about the beam axis, it may be advantageous if a polarization rotation of the difference signal and/or of the sum signal of the two apertures halves, caused by the spatial position of the antenna carrier, can be compensated for by one or more waveguide modules, or by the processor in the processing electronics having a suitable evaluation method. This prevents signals of different polarization from being mixed, and therefore prevents signal interference which can adversely affect the precise readjustment. In principle, two methods can be used for this purpose, depending on the application, the use of waveguide modules as claimed in claim 4, and software processing. Since the position of the antenna carrier is typically known, for example via GPS, the polarization rotation can be calculated in a simple manner, and can then be transferred to the control system for the waveguide module, or to the processor.

If the signals at the difference port and at the sum port are in digitized form, it has been found to be advantageous if the evaluation method in the processor consists of two or more successive values of the amplitude of the baseband difference signal in each case being multiplied, and of these products being added over a specific time $\Delta t$ to form a sum $S_1$, of two or more successive values of the amplitude of the baseband sum signal in each case being multiplied, and of these products being added over a specific time $\Delta t$ to form a sum $S_2$ of the quotient $S_1/S_2$ and/or some other suitable function $f(S_1, S_2)$ being formed after the time interval $\Delta t$ has elapsed, of the value obtained in this way being compared with the standard curve $f_N(\delta, S_1, S_2)$, which is known from a calibration measurement or calculation, using the shortest-interval method or some other suitable method, of the value of the error angle $\delta$ being determined in this way, and this being transferred to the control electronics for the antenna positioner. This method can even be used to process difference signals for which the noise power is higher than the signal power. If the time interval $\Delta t$ is chosen appropriately, all the noise components in the multiplication correlator disappear, and the strength of the signal, which is typically periodic in a generalized form, becomes visible. If the sum signal is also correspondingly processed, then, for example, the quotient $S_1/S_2$ becomes independent of the respective signal amplitudes, and this is a major advantage when the signal strengths are varying. The standard curve $f_N(\delta, S_1, S_2)$, which is independent of the signal strength, can be calculated by simple mathematical methods. However, for precise readjustment, the standard curve can also be measured with the aid of the method and of a suitable satellite transponder or beacon, and can then be stored. Because of its simplicity, the method can even be implemented, for example, using analog electronics.

Since aeronautical antennas in particular are typically mounted under an aerodynamically optimized radome, it may be necessary, because of the physical space, to modify the rectangular shape of apertures according to the invention. In particular, it may be necessary to round the corners of the aperture (horns with powers $p_{11}$, $p_{1N_2}$, $p_{1N_2}$, $p_{N_2N_1}$ in FIG. 1*b*) in order to maintain the necessary clearance from the lower face of the radome. It has been found that a change to the horn edges or a reduction in the size of the horn opening, and even the complete removal of the horns of the horn array at the corners of the aperture has scarcely any influence on the performance of the antenna and its positive characteristics with respect to the antenna characteristic.

In one embodiment, which is not illustrated, the antenna is designed according to the invention up to a total of $N_1/2$ primary horn antenna elements, which are located at the edge of the aperture but are not physically implemented, or their boundary is changed or is reduced in size, the associated cells of the phase equalization grid are correspondingly modified such that the edges of the cells still lie on the edges of the primary horn antenna elements, the aperture configuration according to the invention is implemented only for complete rows in the array of primary horn antenna elements which contain $N_1$ primary horn antenna elements (cf. FIG. 1*b*), and the binary tree structure of the two feed networks (cf. FIG. 1*c*) is appropriately tailored when primary horn antenna elements are missing.

We claim:

1. An antenna for broadband satellite communication comprising an array of primary horn antenna elements which are connected to one another by a waveguide feed network, wherein the array includes a number $N=N_1\times N_2$ of primary horn antenna elements where $N_1>4\ N_2$, $N_1$ and $N_2$ are even integers, the total aperture area A of the antenna is $A=L\times H$, where $L\geqq 4\ H$ and $L<N_1\lambda$, where $\lambda$ is the minimum free-space wavelength of the electromagnetic wave to be transmitted or to be received, the primary horn antenna elements allow the reception and the transmission of two orthogonal linear-polarized electromagnetic waves in that they have a rectangular aperture area $a=l\times h$ where $l<h$ and $l<\lambda$, and each have an approximately square output, where $L=N_1\ l$, $H=N_2\ h$ and $A=N_1\times N_2\times l\times h=L\times H$, and the primary horn antenna elements are fed directly at their output via rectangular waveguides such that one of the orthogonal linear polarizations is supplied and carried away parallel to the aperture area, and the other of the orthogonal linear polarizations is supplied and carried away via a waveguide septum on a plane at right angles to the aperture area, the horns of the primary horn antenna elements are compressed and have a length $l_H<1.5\lambda$ at right angles to the aperture area, and wherein the waveguide feed network comprises a first feed network for one of the two orthogonal linear polarizations and a second feed network, for the other of the two orthogonal linear polarizations, each of the two feed networks is in the form of a binary tree with binary E- and H-power dividers, such that the respective last power divider on the lowest level of the binary tree combines the powers of two half-apertures, in each case with N/2 primary horn antenna elements, for each of the two orthogonal polarizations, separately and symmetrically, the aperture configuration of the antenna in each case approximately follows the relationship:

$$p_{1,j}<p_{2,j}<p_{3,j}<\ldots<p_{k,j}=p_{k+1,j}=p_{k+2,j}=\ldots=p_{k+m,j}>p_{k+m+1,j}>p_{k+m+2,j}>p_{k+m+3,j}>\ldots>p_{2k+m,j}$$

where k and m are integers and $2k+m=N_1$, and the powers $p_{i,j}$, $i=1\ldots N_1$, $j=1\ldots N_2$, denote the power contributions of the individual primary horn antenna elements, the aperture configuration is implemented by symmetrical and asymmetric binary E- and H-power dividers in each of the two feed networks for each of the two orthogonal polarizations, and the entire aperture area is covered by a phase equalization grid, where the meshes of the phase equalization grid have a square dimension with an edge length b, and in each case, approximately, $b=l$, $h=2\ b$ and $b<\lambda$, such that, in the direction $N_1$, the webs of the grid lie above the abutting edge of two adjacent horn antenna elements and, in the direction $N_2$, the webs of the grid are each located approximately precisely at the center of the aperture area of the individual horn antenna elements.

2. The apparatus as claimed in claim 1, wherein the aperture configuration of the antenna in each case approximately follows the relationship:

$$p_{1,j}<p_{2,j}<p_{3,j}<\ldots<p_{k,j}=p_{k+1,j}=p_{k+2,j}=\ldots=p_{k+m,j}>p_{k+m+1,j}p_{k+m+2,j}>p_{k+m+3,j}>\ldots>p_{2k+m,j}$$

where k and m are integers and $m \geqq 2k$, $2k+m=N_1$ and, in each case approximately, $p_{i,j}=P_{2k+m+1-i,j}$ for $i=1 \ldots N_1/2$, and the powers $p_{i,j}$, $i=1 \ldots N_1$, $j=1 \ldots N_2$ denote the power contributions of the individual primary horn antenna elements.

3. The apparatus as claimed in claim 1, wherein the output of the feed network of each of the two orthogonal polarizations is in each case connected by means of a waveguide to a waveguide frequency diplexer, which separates the transmission frequency band from the reception frequency band, and the reception frequency band output of the two waveguide frequency diplexers is in each case connected to a low-noise amplifier.

4. The apparatus as claimed in claim 1, wherein the two orthogonally linear-polarized signals which are present at the two outputs of the feed networks and/or at the outputs of the waveguide frequency diplexers and/or at the outputs of the low-noise amplifiers are fed orthogonally into one or more waveguide modules which consist of two waveguide pieces which are connected to one another along their axis and can be rotated, driven by motors, with respect to one another about the waveguide axis, such that, on the opposite side of the waveguide modules to the feed points, linear-polarized signals whose polarization has been rotated with respect to the orthogonally linear-polarized signals fed in can be output, and the polarization of the incident waves can thus be reconstructed, or the polarization of the waves to be transmitted can be controlled.

5. The apparatus as claimed in claim 4, wherein the antenna is equipped with a waveguide module for polarization tracking for the transmission band, and with a waveguide module, which is separate from the former, for polarization tracking for the reception band.

6. The apparatus as claimed in claim 1, wherein the two orthogonally linear-polarized signals, which are present at the two outputs of the feed networks and/or at the outputs of the waveguide frequency diplexers and/or at the outputs of the low-noise amplifiers, are converted by one or more 90° hybrid couplers to orthogonal circular-polarized signals, such that the antenna can also be used to transmit and/or receive circular-polarized signals.

7. The apparatus as claimed in claim 1, wherein the antenna is fitted on the elevation axis of a two-axis positioner, and the waveguide modules and/or the 90° hybrid couplers are fitted on the azimuth platform of the positioner, and the antenna and the waveguide modules and/or the 90° hybrid couplers are connected to one another by means of flexible radio-frequency cables.

8. The apparatus as claimed in claim 1, wherein all or some of the components of the antenna are entirely or partially silver-plated or copper-plated, all or some of the components are soldered and/or welded and/or adhesively bonded to one another, the antenna, with the exception of the aperture area, is provided entirely or partially from the outside with a protective layer against the ingress of moisture, and a watertight film is introduced on the plane between the primary horns and the phase equalization grid, or on the plane of the horn outputs, which film prevents the ingress of moisture into the primary horns and the waveguide feed network.

9. The apparatus as claimed in claim 1, wherein the last waveguide power divider of each of the two feed networks, which combines the signals from the two aperture halves with in each case N/2 primary horn antenna elements, is designed as a combined E- and H-divider such that both the sum signal of the two symmetrical aperture halves and the difference signal of the two symmetrical aperture halves are applied to this waveguide four-port network, and both the sum signal and the difference signal can be passed out separately for each of the two orthogonal polarizations.

10. The apparatus as claimed in claim 9, wherein the difference port of the combined E- and H-divider is equipped with a transmission band stop filter, which prevents the transmission signals from entering the difference branch, and the difference port is connected via the transmission band stop filter to a low-noise amplifier.

11. The apparatus as claimed in claim 1, wherein the difference signals and/or some of the sum signals of the two symmetrical aperture halves are passed to processing electronics, which evaluate the strength and/or the phase angle of the difference signals and/or of the sum signals and transfers/transfer them/this to the control electronics of the antenna positioner, such that the control electronics can readjust the antenna such that the difference signal is a minimum, and the antenna thus remains aligned with the target satellites when the antenna carrier is moving relative to the target satellite.

12. The apparatus as claimed in claim 11, wherein the processing electronics for the difference signals and/or the sum signals contains one or more fixed frequency mixers and/or one or more controllable variable-frequency mixers and one or more frequency filters, by means of which the difference signal or a portion of the difference signal and/or the sum signal or a portion of the sum signal can be converted to a defined baseband, and can be processed there.

13. The apparatus as claimed in claim 12, wherein the strength of the difference signal and/or of the sum signal in baseband is measured by a suitable electronic circuit, and is transferred to the control electronics of the antenna positioner.

14. The apparatus as claimed in claim 12, wherein the difference signal and/or the sum signal is digitized in baseband by an analog/digital converter, and is passed to a processor which has suitable evaluation methods for determining the strength and/or the phase angle of the difference signal and/or of the sum signal and for transferring this information to the control electronics of the antenna positioner.

15. The apparatus as claimed in claim 14, wherein the processor has an evaluation method by means of which it is possible to compensate for the Doppler frequency shift which occurs in the difference signal and/or in the sum signal when the antenna carrier is moving fast.

16. The apparatus as claimed in claim 14, wherein the evaluation method in the processor consists of two or more successive values of the amplitude of the baseband difference signal in each case being multiplied, and of these products being added over a specific time $\Delta t$ to form a sum $S_1$, of two or more successive values of the amplitude of the baseband sum signal in each case being multiplied, and of these products being added over a specific time $\Delta t$ to form a sum $S_2$ of the quotient $S_1/S_2$ and/or some other suitable function $f(S_1, S_2)$ being formed after the time interval $\Delta t$ has elapsed, of the value obtained in this way being compared with the standard curve $f_N(\delta, S_1, S_2)$, which is known from a calibration measurement or calculation, using the shortest-interval method or some other suitable method, of the value of the error angle $\delta$ being determined in this way, and this being transferred to the control electronics for the antenna positioner.

17. The apparatus as claimed in claim 1, wherein a polarization rotation of the difference signal and/or of the sum signal of the two apertures halves, caused by the spatial position of the antenna carrier, can be compensated for by one or more waveguide modules, or by the processor in the processing electronics having a suitable evaluation method.

18. The apparatus as claimed in claim 1, wherein up to a total of $N_1/2$ primary horn antenna elements, which are located at the edge of the aperture, are not physically implemented, or their boundary is changed or is reduced in size, the associated cells of the phase equalization grid are correspondingly modified such that the edges of the cells still lie on the edges of the primary horn antenna elements, the aperture configuration is implemented only for complete rows in the array of primary horn antenna elements which contain $N_1$ primary horn antenna elements, and the binary tree structure of the two feed networks is appropriately tailored when primary horn antenna elements are missing.

* * * * *